US005092589A

United States Patent [19]

Packer

[11] Patent Number: 5,092,589

[45] Date of Patent: Mar. 3, 1992

[54] AQUATIC PHYSICAL THERAPY DEVICE AND METHOD OF USE

[76] Inventor: Kimberly A. Packer, 123 Haymac, Parchment, Mich. 49004

[21] Appl. No.: 499,794

[22] Filed: Mar. 27, 1990

[51] Int. Cl.[5] ..... A63B 23/00

[52] U.S. Cl. ..... 272/116; 272/71; 272/1 B; 441/129

[58] Field of Search ..... 272/1 B, 71, 116; 128/25 R; 441/60, 67, 129

[56] References Cited

U.S. PATENT DOCUMENTS

| | | | |
|---|---|---|---|
| 4,443,204 | 4/1984 | Perrin | 441/129 |
| 4,551,108 | 11/1985 | Bass | 272/71 |
| 4,671,507 | 6/1987 | Huttner | 272/71 |
| 4,722,329 | 2/1988 | Kalvag | 441/129 X |
| 4,828,522 | 5/1989 | Santos | 272/1 B |
| 4,840,591 | 6/1989 | Dulin et al. | 441/129 X |
| 4,948,118 | 8/1990 | Miraglia | 272/71 |

*Primary Examiner*—Richard J. Apley

*Assistant Examiner*—Glenn E. Richman

*Attorney, Agent, or Firm*—Flynn, Thiel, Boutell & Tanis

[57] ABSTRACT

An aquatic physical therapy device which enables the user to manually assist the movement of the user's legs. Alternatively, the hands of the user can be restrained in order that the legs of the user can be intensively exercised. The aquatic physical therapy device of the present invention comprises a buoyant member having an opening provided therein and a plurality of strap guide members provided around a lower peripheral surface thereof. A removable body support member is provided within the opening of the buoyant member and attached thereto. A strap having a leg grasping member provided at a lower portion thereof passes through strap guide members such that the upper portion of the straps are available for manual manipulation. Hand movement restraining means are additionally provided on the outer peripheral surface of the buoyant member. By pulling and releasing the straps, the user can assist in the movement of the user's legs while in the water.

7 Claims, 3 Drawing Sheets

FIG. 1
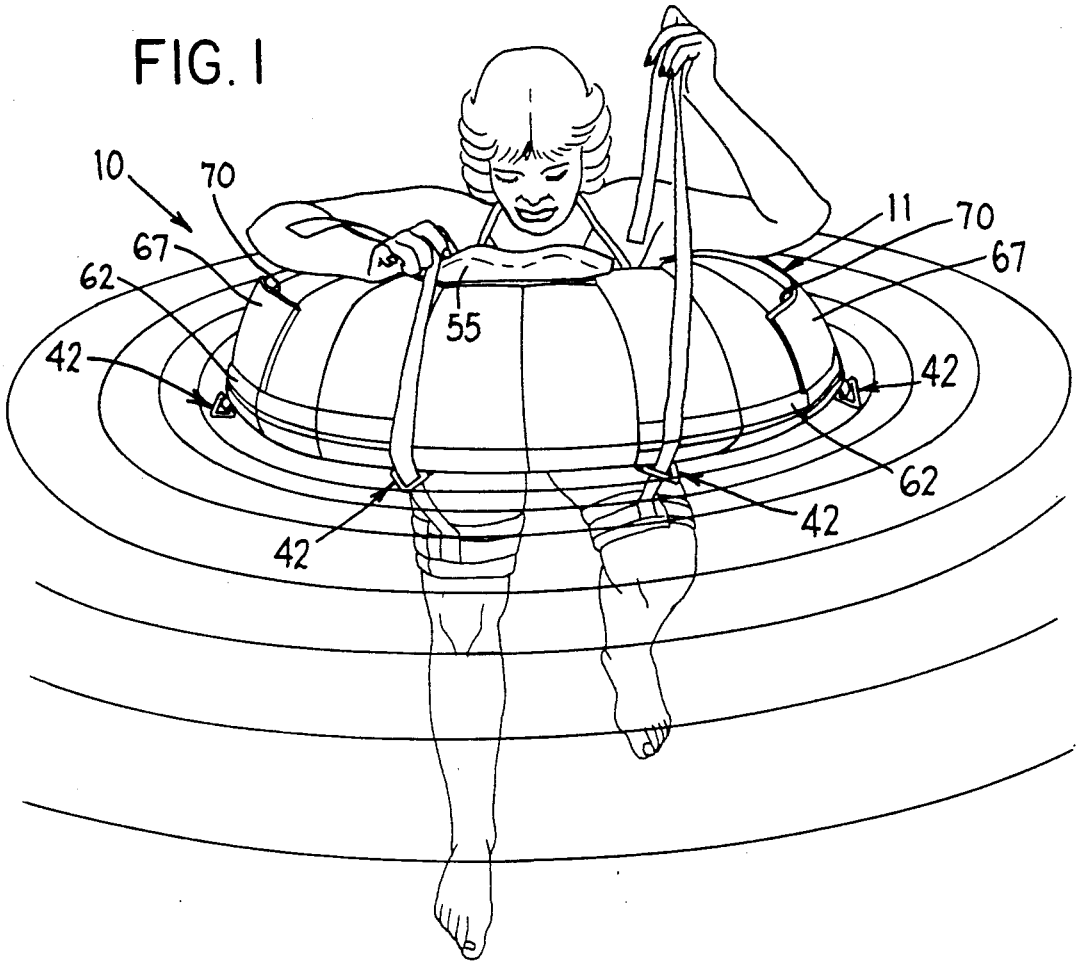
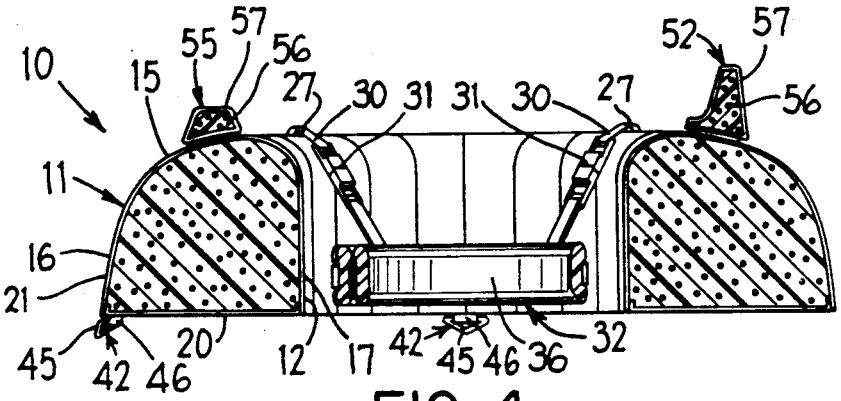
FIG. 4

AQUATIC PHYSICAL THERAPY DEVICE AND METHOD OF USE

BACKGROUND OF THE INVENTION

Aquatic physical therapy is often used as part of the rehabilitative treatment of injuries to the spine and limbs in general and to injuries to the spine and legs in particular. Aquatic physical therapy is particularly effective in the rehabilitation of injuries to the legs and spine because the viscosity of the water presents a resistance to the movement of the legs and yet relieves the stress of gravity on the legs and spine because of its buoyancy effect on the human body.

Although aquatic physical therapy is very useful in the treatment of injuries to the spine and limbs, it has drawbacks in that it is often necessary that a trained physical therapist assist the patient undergoing rehabilitation. That is, although the water helps reduce the strain that is placed on the patient's spine and legs during exercise, it is still often necessary for the physical therapist to support the patient and assist in the movement of the patient's legs during the treatment. Therefore, the physical therapist can only assist one patient at a time during the aquatic rehabilitative treatment which reduces the effectiveness of the physical therapist and only enables the patient to undergo aquatic physical therapy when a physical therapist is available to assist them.

Accordingly, an object of the present invention is to provide an aquatic physical therapy device which enables the patient to conduct aquatic rehabilitation exercises without the direct assistance of a physical therapist.

Another object of the present invention is to provide an aquatic physical therapy device which allows the user to manually assist the movement of his or her legs during aquatic rehabilitative treatment.

A further object of the present invention is to provide an aquatic physical therapy device which maximizes the intensive workout of a patient's legs by restraining the movement of the patient's hands and arms during the aquatic rehabilitative exercises.

A still further object of the present invention is to provide a method of using the above-disclosed aquatic physical device of the present invention.

SUMMARY OF THE INVENTION

The objects and purposes of the invention, including those set forth above, are met by providing an aquatic physical therapy device comprising a buoyant member having an opening provided therein and a plurality of strap guides provided around a lower outer peripheral surface thereof. A body support member is contained within the opening of the buoyant member and removably attached thereto. At least one flexible leg manipulation member comprising a leg grasping part provided at a lower portion thereof passes through the strap guides and is adapted for engagement with the user's hands in order to aid in the manipulation of the user's legs.

Another embodiment of the present invention comprises a buoyant member having an opening provided therein, a body support member contained within the opening of the buoyant member and removably attached thereto, and means for re30 straining the movement of the user's hands provided on an outer peripheral surface of the buoyant member.

The present invention also comprises methods of performing aquatic physical therapy by utilizing the devices of the present invention.

BRIEF DESCRIPTION OF THE DRAWINGS

Other objects, purposes and advantages of the invention will be apparent to persons acquainted with physical therapy upon reading the following specification and inspecting the accompanying drawings, in which:

FIG. 1 is a perspective view of one embodiment of an aquatic physical therapy device according to the present invention;

FIG. 4 is a sectional view taken along the line IV—IV of FIG. 2 and rotated 90°;

Figure 2:
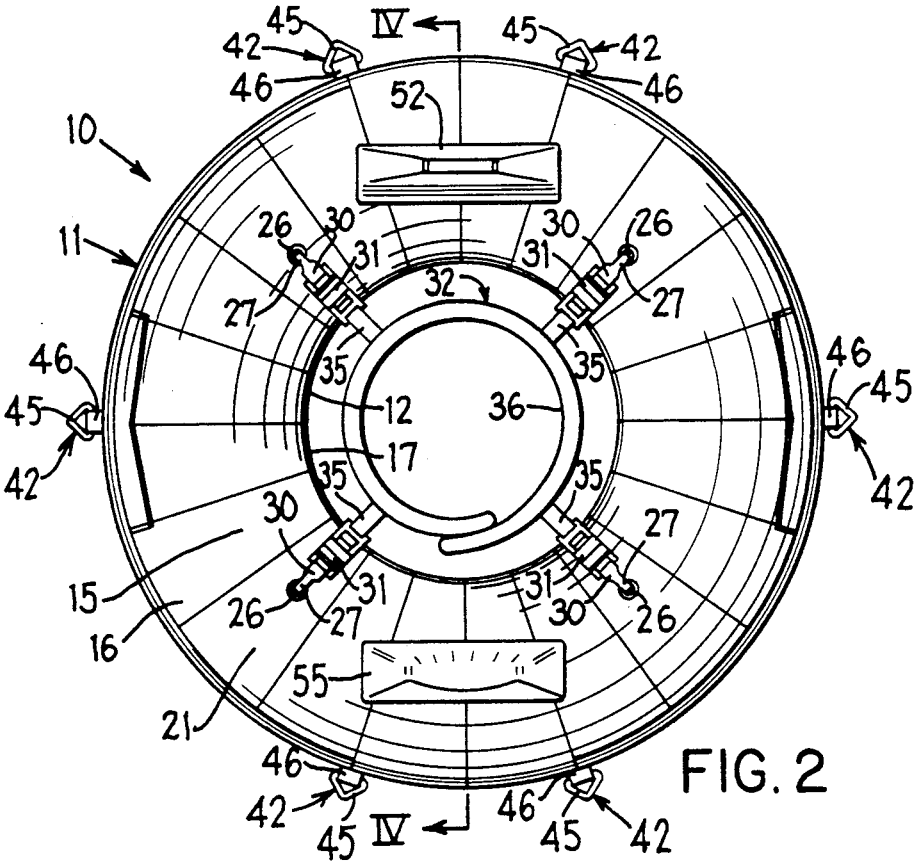
FIG. 2 is a top view of the aquatic physical therapy device of FIG. 1.

The words "up", "down", "forward" and "rearward" will be used in the following description for convenience to designate directions in the drawings to which reference is made. Such terminology will include derivatives of said words and words of similar import.

DETAILED DESCRIPTION

An aquatic physical therapy device 10 illustrated in FIGS. 1–4 includes a buoyant member 11 having an opening 12 contained therein. The buoyant member 11 is of circular configuration and has a curved upper surface 15, a rounded outer peripheral surface 16, a substantially flat inner surface 17 and a substantially flat bottom surface 20. Alternatively, the buoyant member 11 can be in the form of a "horseshoe", square, triangle or other different configurations and still function adequately in the present invention. The bottom surface 20 of the buoyant member 11 is flattened in order to provide maximum stability to the device 10. The size of the buoyant opening 12 can be varied to fit the size of the user. That is, when a child is utilizing the device 10 of the present invention, the size of the opening 12 is necessarily smaller than it would be for an adult. Consequently, the outer diameter of the buoyant member 11 would also be varied according to the size of the user. It is well within the skill of the art to arrive at an optimum diameter of the buoyant member 11 and size of the opening 12 depending on the size and weight of the user and the degree of buoyancy desired.

The buoyant member 11 can be made of any material having a specific gravity less than that of water. Materials containing organic polymers, such as polyolefins and polyaryl compounds are particularly preferred in the present invention, with materials containing polyolefins being especially preferred. In terms of cost and ease of manufacture, a closed cell, chemically crosslinked polyethylene-vinyl acetate copolymer having a three pound per cubic foot density (such as Minicel ®, T300 by Voltek) has been proven to be especially suitable as the material of construction of the buoyant member 11 of the present invention. The buoyant member 11 can be formed by conventional molding techniques or by laminating sheets of the buoyant material to a desired thickness by heat or an adhesive and then mechanically working the laminate by cutting and shaping implements to obtain a buoyant member 11 of the desired configuration.

Figure 3:
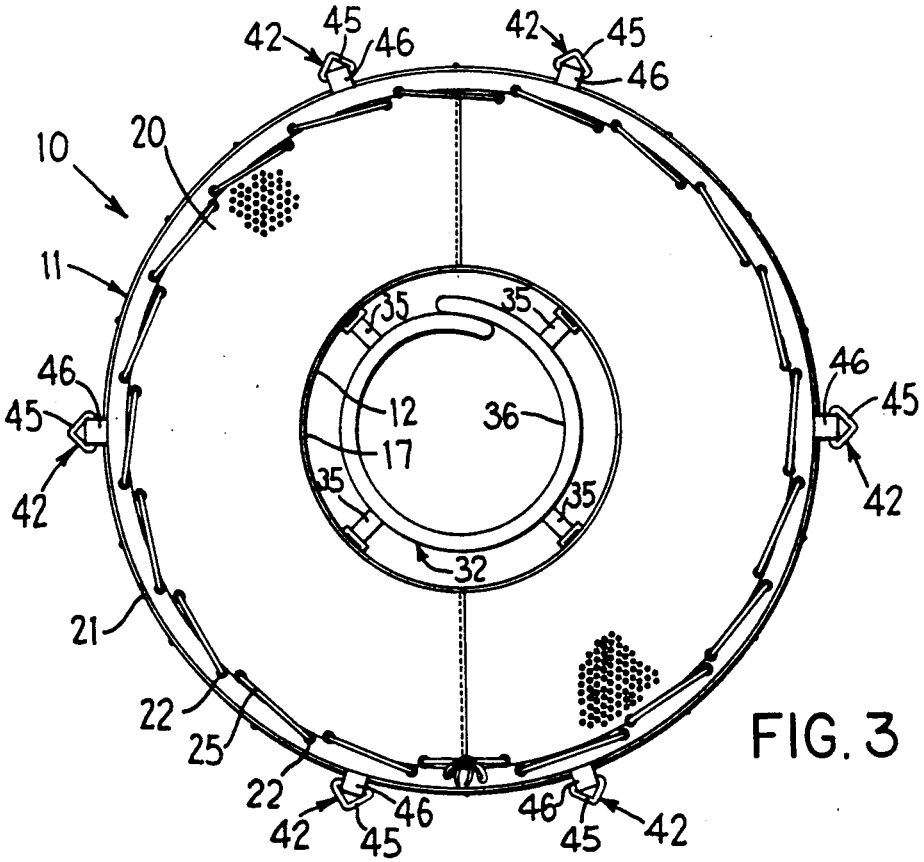
FIG. 3 is a bottom view of the aquatic physical therapy device of FIG. 1.

The buoyant member 11 can additionally include a cover 21 made of a water-resistant material, such as a polyvinyl material, which encloses the buoyant material. As shown in FIG. 3, the bottom of the cover 21 is perforated in order to aid in the draining of water therefrom. The cover 21 can contain a plurality of grommets 22 through which a cord 25 can be passed in order to secure the cover 21 on the buoyant material. As shown in FIG. 2, a plurality of grommets 26 are equidistantly positioned on the upper surface of the cover 21. Each grommet 26 in the upper cover surface is adapted to receive a securing member, such as a hook 27, therein. The hooks 27 are fixed to the ends of straps 30 having fastening devices, such as buckles 31, contained at the opposite ends thereof.

The body support member 32, which can be a harness or seat 37, is provided with a plurality of straps 35 at an outer surface thereof, which engage with and are fastened by the buckles 31 to support the body support member 32 within the buoyant member opening 12. When the body support member 32 is in the form of a harness, it comprises a belt member 36 having the straps 3 attached thereto at its outer surface. The belt member 36 is adjustingly fitted about the user's waist and can be opened, closed and adjusted by providing fastening means, such as Velcro ® (not shown), on opposed mating surfaces thereof. The harness belt body support member 32, in combination with the buoyant member 11, provides support for the user in water and yet enables the user to have maximum use of their legs and arms.

Figure 7:
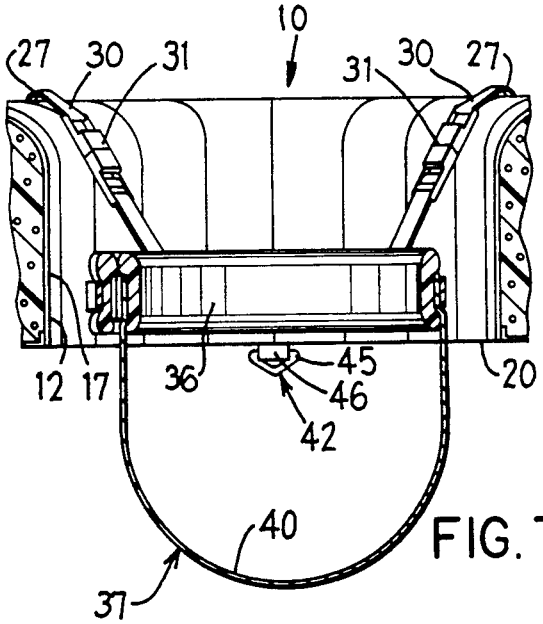
FIG. 7 is an enlarged partial view of FIG. 4 showing a seat contained in the aquatic physical thereapy device.

Alternatively, the belt member 36 can be replaced by a seat 37 to provide support for the user. As shown in FIG. 7, the seat 37 is similar to the harness in that it also has a belt member 36 which is adjustably fitted around the user's waist. However, the seat 37 also comprises a buttocks support member 40 which can be a strap which extends from and is connected to the front and rear of the belt member 36. The user's legs extend from openings formed between the belt member 36 and the buttocks support member 40. The seat 37 is used when it is necessary to provide additional support to the user because of the weakened condition of the user's legs.

A plurality of strap guide members 42 are provided around and fixedly connected to the outer, lower peripheral surface of the buoyant member 11. The strap guide members 42 comprise triangularly shaped guide pieces 45 which are fixedly secured to one end of a short strap member 46 which is fixedly attached to the buoyant member 11 at its other end.

Figure 8:
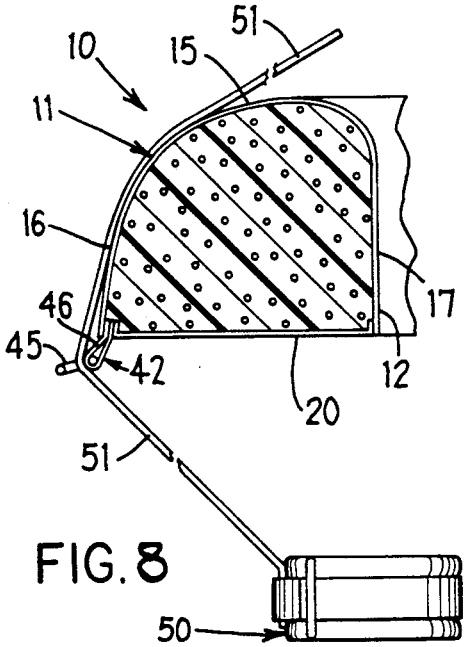
FIG. 8 is a side view showing the leg holding member of the aquatic physical therapy device of FIG. 1.

As shown in FIG. 8, the device 10 has a flexible leg manipulation member which comprises a leg holding member 50 connected to the lower end of a strap 51 which passes through the strap guide member 42 and over the outer curved peripheral surface 16 of the buoyant member 11 to a position where the upper portion of the strap 51 can be grasped by the user's hand. The leg holding member 50 comprises a flexible strip of material, such as nylon or a polyvinyl material, having Velcro ® provided on mating surfaces thereof. The strip of material is wrapped around the user's leg and secured in place by pressing the mating surfaces together. As shown in FIG. 1, by manually pulling and releasing the straps 51, the user can assist in the movement of the user's leg in the water. By placing the straps 51 through the strap guide members 42 positioned at the front of the buoyant member 11, the user can perform flexion and extension exercises of the hip and/or knee. Alternatively, by positioning the straps 51 through the guide members 42 positioned on the buoyant member 11 at the sides of the user, the user can perform abduction and adduction exercises of the leg and hip. During these abduction and adduction exercises, the straps 51 are brought across the buoyant member 11 and grasped by the user's hand opposite the body part that is being exercised. That is, when the right leg or hip is being exercised, the left hand is used to manipulate the strap 51 and vice versa. By positioning the straps 51 through the guide members 42 positioned at the rear of the buoyant member and passing the straps over the user's shoulders, the user can perform exercises that hyperextend the hips and spine by pulling down on the straps. The upper end of the strap 51 can optionally be provided with a holding means, such as a handle or a loop, to aid the user in holding the strap 51. Another benefit of the inventive device 10 is that the user's arms also receive exercise during the exercise of the user's legs and hips.

A chin rest 52 and a back neck rest 55 may additionally be provided with the present invention. As shown in FIG. 4, the chin rest 52 and the back neck rest 55 comprise a buoyant inner material 56, preferably the same material as that of the buoyant member 11, and an outer cover 57. The bottom of the chin rest 52 and the back neck rest 55 are provided with Velcro ® 60 and are adapted to engage with mating Velcro ® strips provided on the front and rear of the buoyant member upper surface 15. Therefore, the chin rest 52 and the back neck rest 55 can be removed when it is not necessary to provide support to the user's chin or to the back of the user's neck.

Figure 5:
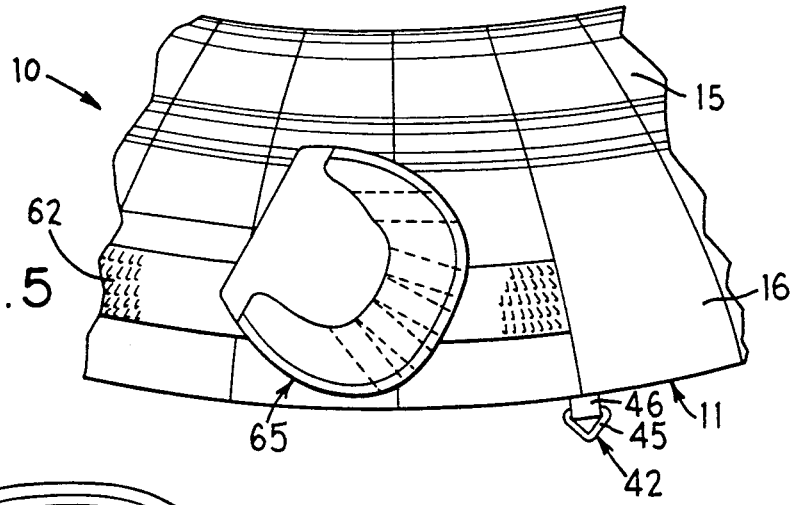
FIG. 5 is a plan view of an aquatic physical therapy device of the present invention with a hand restraining member attached to an outer peripheral surface of the buoyant member.
Figure 6:
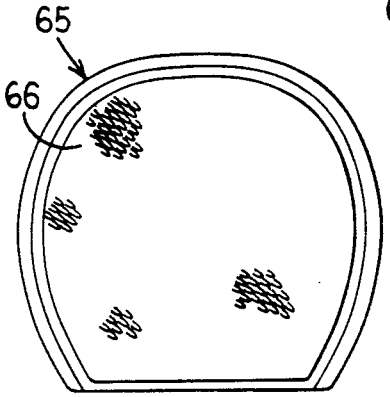
FIG. 6 is a backside view of the hand restraining member of FIG. 5.

In situations where the user's legs are sufficiently strong as to not need any assistance from the leg manipulation member 47, the leg manipulation members 47 can be removed. In order to maximize the exercise of the user's legs, the user's hands and arms should be restrained from movement during the exercise of the legs. In order to further this object, hand movement restraining members are provided for in the present invention. The hand movement restraining members can comprise Velcro ® strips 62 provided around the outer peripheral surface 16 of the buoyant member 11. As shown in FIGS. 5 and 6, the hand movement restraining member additionally comprises a glove member 65 which is adapted to receive a hand of the user. The bottom side of the glove member 65 also has Velcro ® 66 provided thereon which engages with and becomes removably secured to the Velcro ® strips 62 provided on the outer peripheral surface 16 of the buoyant member 11. The glove member 65 preferably is made of the same buoyant material as that of the buoyant member 11 and can be in the form of a mitten (not illustrated) where a separate sheath is only provided for the thumb or the illustrated glove where each finger has a separate sheath. By the user's hands being placed in the glove member 65 and the glove member secured to the Velcro ® strip 62 provided around the outer peripheral surface of the buoyant member 11, the user's hands and arms are effectively prevented from movement during the exercise of the user's legs which prevent unwanted contractions in the user's body and thereby isolates the muscles to be exercised more effectively. Alternatively, pockets 67 adapted to receive the user's hands can be provided on the outer peripheral surface 16 of the buoyant member and also serve as hand movement restraining members. A pocket 67 is formed from a piece of material attached to the cover 21 in such a manner that an opening 70 is provided between the upper portion of the material and the cover 21 to receive and confine the user's hand.

Although specific embodiments of the invention have been disclosed in detail for illustrative purposes, it will be recognized that variations or modifications of the disclosed device, including the rearrangement of parts, lie within the scope of the present invention.

The embodiments of the invention is which an exlcusive property or privilege is claimed are defined as follows:

1. An aquatic physical therapy device comprising: a buoyant member having an opening provided therein; a human body support member contained within said opening and attached to said buoyant member; and at least one human leg flexible manipulation member slidably engaged with said byoyant member, said human leg flexible manipulation member comprising means for manual operation of said human leg flexible manipulation member and thereby manipulating a user's leg.

2. The device of claim 1, wherein said buoyant member has a circular configuration.

3. The device of claim 1, wherein said buoyant member has a rounded upper surface and a substantially flat lower surface.

4. The device of claim 1, wherein said human body support member is removably attached to said buoyant member.

5. The device of claim 1, wherein said human body support member is selected from the group consisting of a harness belt and a seat.

6. The device of claim 1, wherein said human leg flexible manipulation member comprises a strap and a leg holding member.

7. The device of claim 1, wherein said byoyant member has a detachable head rest member and a detachable neck rest member provided thereon.

* * * * *

UNITED STATES PATENT AND TRADEMARK OFFICE

CERTIFICATE OF CORRECTION

PATENT NO. : 5 092 589

DATED : March 3, 1992

INVENTOR(S) : Kimberly A. Packer

It is certified that error appears in the above-identified patent and that said Letters Patent is hereby corrected as shown below:

Column 1, line 68; change "re30 straining" to ---restraining---.

Column 3, line 33; change "3" to ---35---.

Signed and Sealed this

Sixth Day of July, 1993

Michael K. Kirk

MICHAEL K. KIRK

*Acting Commissioner of Patents and Trademarks*

*Attest:*

*Attesting Officer*